US008465323B2

(12) United States Patent
Jeon

(10) Patent No.: US 8,465,323 B2
(45) Date of Patent: Jun. 18, 2013

(54) ELECTRICAL CONNECTOR WITH INTERFACE GROUNDING FEATURE

(75) Inventor: Myoungsoo Jeon, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 79 days.

(21) Appl. No.: 13/270,622

(22) Filed: Oct. 11, 2011

(65) Prior Publication Data

US 2013/0089993 A1 Apr. 11, 2013

(51) Int. Cl.
*H01R 23/688* (2006.01)

(52) U.S. Cl.
USPC ..... 439/607.07

(58) Field of Classification Search
USPC ..... 439/607.07, 607.08, 108, 100, 607.05, 439/98
See application file for complete search history.

(56) References Cited

U.S. PATENT DOCUMENTS 4,720,770 A * 1/1988 Jameson ..... 361/705
6,752,640 B2 * 6/2004 Chen ..... 439/92
6,971,916 B2 * 12/2005 Tokunaga ..... 439/607.09
7,104,843 B2 * 9/2006 Olson et al. ..... 439/607.18
7,381,092 B2 * 6/2008 Nakada ..... 439/607.1

* cited by examiner

*Primary Examiner* — Tulsidas C Patel
*Assistant Examiner* — Phuongchi T Nguyen

(57) ABSTRACT

An electrical connector that includes a connector body having a conductive surface configured to oppose an engagement side of a mating connector. The electrical connector also includes electrical terminals that are held by the connector body and located in an array along the conductive surface. Adjacent terminals are separated by gaps that collectively form an interwoven reception region along the conductive surface between the electrical terminals. The electrical connector also includes ground contacts that are coupled to the conductive surface and are located in corresponding gaps. The ground contacts include flex portions that are configured to be compressed between the conductive surface and the engagement side of the mating connector when the mating connector is coupled to the electrical connector during a mating operation. The ground contacts are configured to electrically couple the conductive surface and the mating connector.

20 Claims, 5 Drawing Sheets

ELECTRICAL CONNECTOR WITH INTERFACE GROUNDING FEATURE

BACKGROUND OF THE INVENTION

The subject matter herein relates generally to electrical connectors, and more particularly, to electrical connectors having grounding features to improve electrical performance.

To meet digital communication demands, higher data throughput in smaller spaces is often desired for communication systems and equipment. Electrical connectors that interconnect circuit boards and other electrical components should therefore handle high signal speeds at large contact densities. One application environment that uses such electrical connectors is in high speed, differential electrical connectors, such as those common in the telecommunications or computing environments. In a traditional approach, two circuit boards are interconnected to each other in a backplane and a daughter card configuration using electrical connectors mounted to each circuit board.

At least one problem area in this interconnection is the interface between the two electrical connectors. In some cases, the electrical connectors include conductive shields that may be, for example, the housings of the electrical connectors. When the electrical connectors are mated together, the housings are also electrically coupled thereby establishing a return path between the electrical connectors. However, gaps along the interface can occur due to, for example, manufacturing tolerances of the electrical connectors or unwanted particles (e.g., dirt or dust) between the electrical connectors. These gaps can negatively affect the electrical performance of the connector assembly.

Accordingly, there is a need for electrical connectors and connector assemblies that can create a reliable interconnection between two electrical connectors along a mating interface.

BRIEF DESCRIPTION OF THE INVENTION

In one embodiment, an electrical connector is provided that includes a connector body having a conductive surface configured to oppose an engagement side of a mating connector. The electrical connector also includes electrical terminals that are held by the connector body and located in an array along the conductive surface. Adjacent terminals are separated by gaps that collectively form an interwoven reception region along the conductive surface between the electrical terminals. The electrical connector also includes ground contacts that are coupled to the conductive surface and are located in corresponding gaps. The ground contacts include flex portions that are configured to be compressed between the conductive surface and the engagement side of the mating connector when the mating connector is coupled to the electrical connector during a mating operation. The ground contacts are configured to electrically couple the conductive surface and the mating connector.

In another embodiment, an electrical connector is provided that includes a connector body having a conductive surface configured to oppose an engagement side of a mating connector. The electrical connector also includes a grounding matrix having ground contacts that are interconnected in a web-like manner. The grounding matrix extends alongside the conductive surface and defines a plurality of openings. The electrical connector also includes electrical terminals that are coupled to the conductive surface and configured to engage mating terminals of the mating connector. The grounding matrix is configured to electrically couple the engagement side of the mating connector and the conductive surface when the mating connector and the electrical connector are mated. At least one of the electrical terminals or the mating terminals extends through the openings of the grounding matrix after the mating operation.

In a further embodiment, an electrical connector assembly is provided that includes a mating connector having an engagement side and a plurality of mating terminals located therealong. The connector assembly also includes a grounding matrix having ground contacts that are interconnected in a web-like manner. The grounding matrix defines a plurality of openings. The connector assembly also includes a header connector having a connector body that includes a conductive surface configured to oppose the engagement side of the mating connector. The header connector also includes electrical terminals coupled to the connector body in an array and configured to engage mating terminals of the mating connector. The grounding matrix is located between the engagement side and the conductive surface along a mating interface. The grounding matrix electrically couples the engagement side and the conductive surface after a mating operation. At least one of the electrical terminals or the mating terminals extends through the openings of the grounding matrix.

DETAILED DESCRIPTION OF THE INVENTION

Embodiments described herein include electrical connectors and connector assemblies having grounding features. For example, exemplary connector assemblies include two electrical connectors that are configured to mate with each other and grounding features that are configured to establish a return path between the two electrical connectors. The grounding features may be located along a mating interface that exists between corresponding conductive surfaces of the electrical connectors. The grounding features may include ground contacts that engage at least one of the conductive surfaces. In an exemplary embodiment, the ground contacts are interconnected together in a web-like manner to form a grounding matrix. However, in other embodiments, the ground contacts are not interconnected and, instead, may be independently located on, for example, one of the conductive surfaces. The ground contacts may include flex portions that move independently with respect to each other thereby allowing the conductive surfaces to be electrically connected through multiple contact points.

Figure 1:
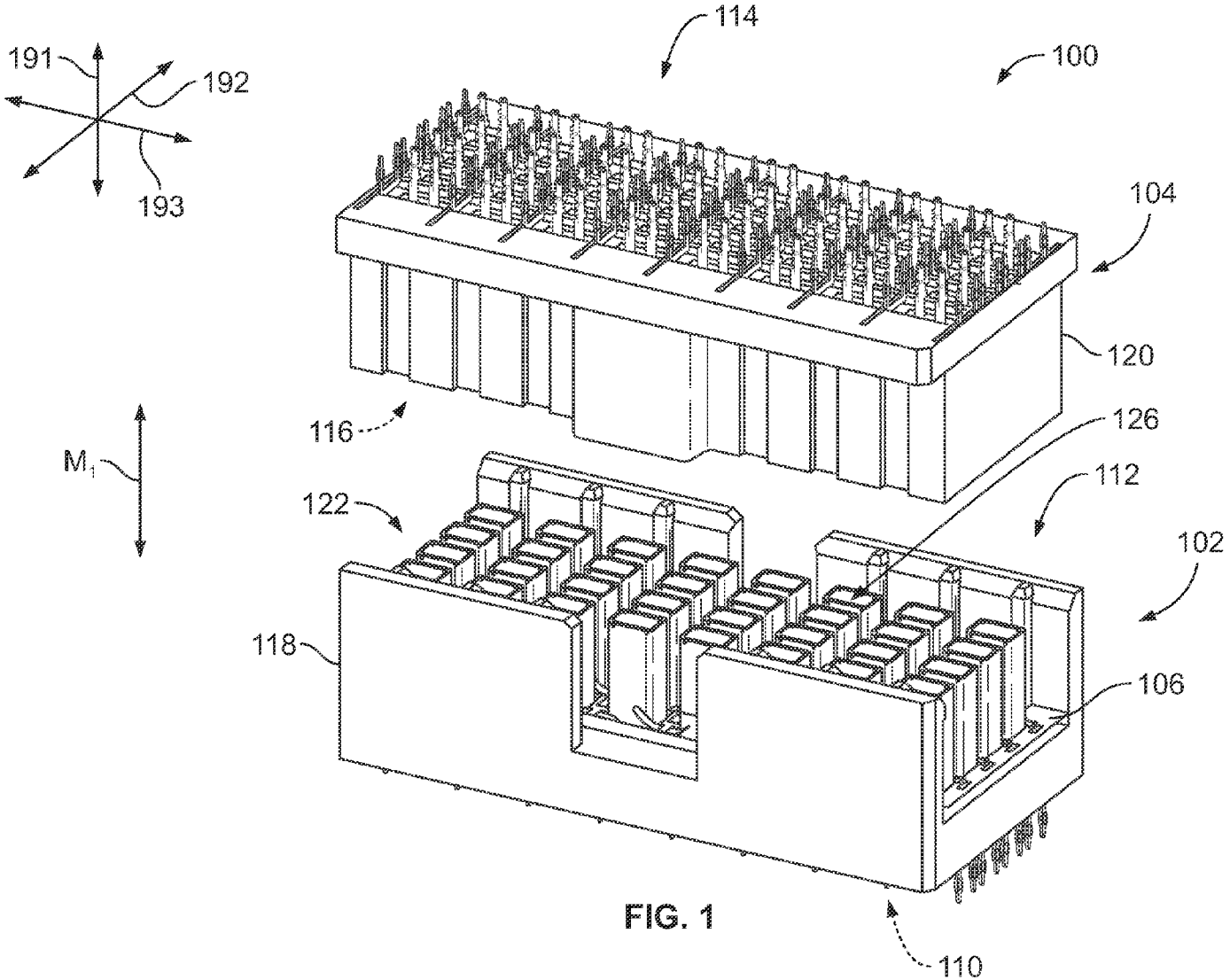
FIG. 1 illustrates an electrical connector assembly formed in accordance with one embodiment that includes grounding features.

FIG. 1 illustrates an electrical connector assembly 100 formed in accordance with an exemplary embodiment. The connector assembly 100 includes first and second electrical connectors 102, 104 and a grounding matrix 106 held by the electrical connector 102. In other embodiments, the electrical connector 104 may hold the grounding matrix 106. The electrical connectors 102, 104 are configured to engage each other and establish an electrical connection therebetween during a mating operation. (In order to distinguish the first and second electrical connectors, the first electrical connector 102 may be referred to as a header connector and the second electrical connector 104 may be referred to as a mating connector.) As shown, the connector assembly 100 is oriented with respect to mutually perpendicular axes 191-193 including a mating axis 191 and lateral axes 192, 193.

The electrical connector 102 has a mounting side 110 and an engagement side 112, and the electrical connector 104 also has a mounting side 114 and an engagement side 116. In the illustrated embodiment, the mounting and engagement sides 110, 112 face in opposite directions along the mating axis 191 and the mounting and engagement sides 114, 116 also face in opposite directions. As such, the electrical connectors 102, 104 may be characterized as vertical connectors. However, in alternative embodiments, the electrical connectors 102 and 104 may be right-angle connectors in which the respective mounting and engagement sides face in perpendicular directions with respect to each other. The mounting sides 110, 114 are configured to engage respective electrical components, such as circuit boards (not shown).

The electrical connector 102 includes a connector body or housing 118, and the electrical connector 104 includes a connector body 120. The connector bodies 118, 120 comprise conductive material (e.g., metal, a mold with conductive particles, and the like). The connector bodies 118, 120 may form a return path when the electrical connectors 102, 104 are mated. The electrical connector 102 includes electrical terminals 122 that are held by the connector body 118 in an array. The electrical connector 104 also includes electrical terminals 124 (shown in FIG. 8). The electrical terminals 124 may also be referred to as mating terminals. In an exemplary embodiment, the electrical connector 102 has a body-receiving cavity 126 that opens to the engagement side 112. The receiving cavity 126 is sized and shaped to receive the connector body 120.

During the mating operation, the receiving cavity 126 receives the engagement side 116. The electrical terminals 122, 124 engage each other and establish the electrical connection. When the electrical connectors 102, 104 are engaged, the grounding matrix 106 operates to electrically couple the connector bodies 118, 120 along a mating interface 224 (shown in FIG. 9). In alternative embodiments, the engagement side 116 includes a receiving cavity and the engagement side 112 is configured to be received by the receiving cavity of the engagement side 116.

When the electrical connectors 102, 104 are mated, the electrical connectors 102, 104 are moved relatively toward each other along a mating direction $M_1$ that extends substantially parallel to the mating axis 191. The mating direction $M_1$ is indicated as being bi-directional because the electrical connector 102 may be moved toward the electrical connector 104 or vice versa. Furthermore, both of the electrical connectors 102, 104 can be moved toward each other at the same time. In an exemplary embodiment, the electrical terminals 122, 124 slidably engage each other during the mating operation.

In an exemplary embodiment, the electrical connector 102 is a backplane connector and the electrical connector 104 is a daughter card connector. However, in alternative embodiments, the electrical connector 102 may be a daughter card connector and the electrical connector 104 may be a backplane connector. While the connector assembly 100 is described herein with reference to a backplane connector and a daughter card connector, it is realized that the subject matter herein may be utilized with different types of electrical connectors other than a backplane connector or a daughter card connector. The backplane connector and the daughter card connector are merely illustrative of an exemplary embodiment of the connector assembly 100. In particular embodiments, the connector assembly 100 transmits high-speed data signals. For example, the data signals may be transmitted at speeds greater than or equal to 15 Gbps. In more particular embodiments, the data signals may be transmitted at speeds greater than or equal to 20 Gbps or greater than or equal to 25 Gbps. However, in other embodiments, the connector assembly 100 may transmit data signals at slower speeds.

Figure 2:
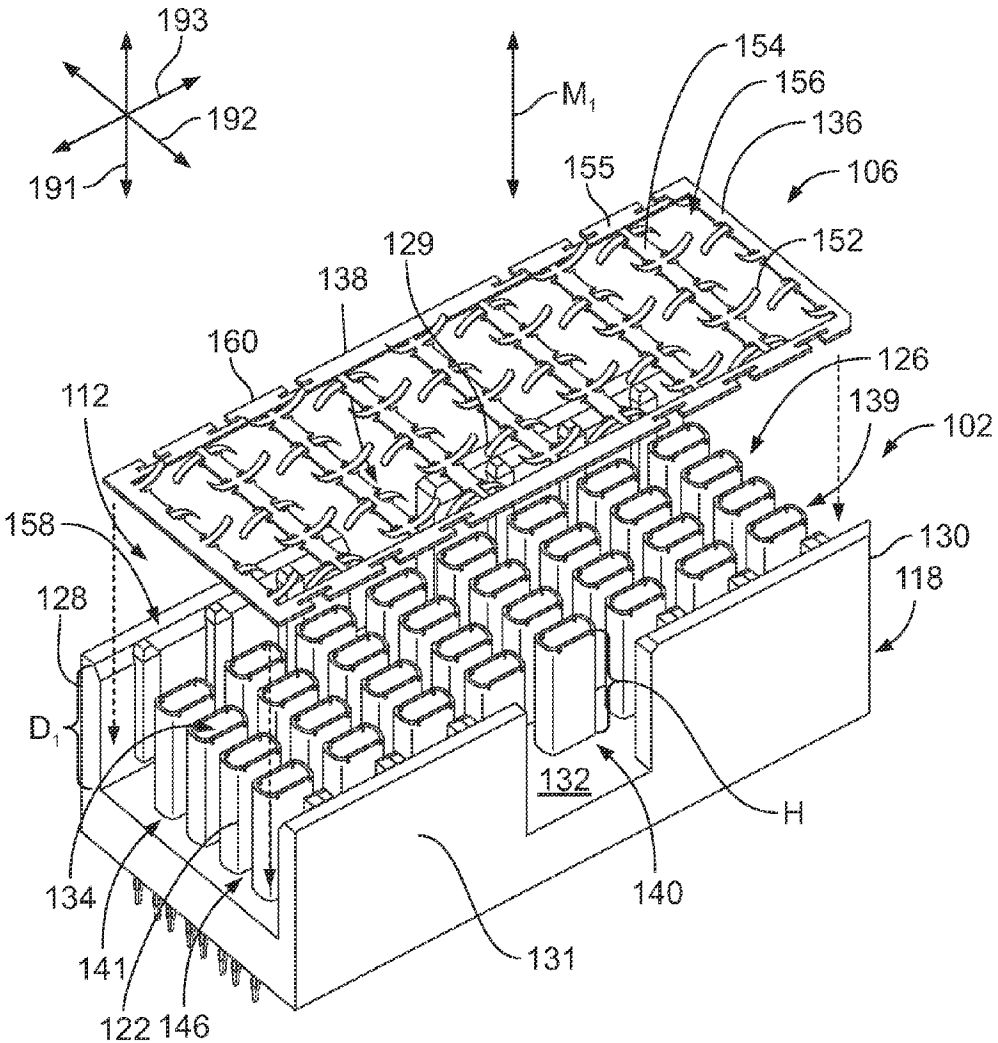
FIG. 2 is a perspective view of an electrical connector formed in accordance with one embodiment and a grounding matrix.

FIG. 2 is a perspective view of the electrical connector 102 and the grounding matrix 106. In an exemplary embodiment, the connector body 118 includes housing walls 128-131 and a conductive surface 132 that define the receiving cavity 126. The housing walls 128-131 project from the conductive surface 132 along the mating axis 191. The conductive surface 132 is located a depth $D_1$ into the receiving cavity 126 measured from edges of the housing walls 128-131. As shown, the receiving cavity 126 not only opens to the engagement side 112 in a direction along the mating axis 191 but also opens to the exterior of the electrical connector 102 in directions along the lateral axes 192, 193. More specifically, the housing walls 128-131 may have openings 138-141 therebetween that provide access to the receiving cavity 126 from the exterior. In some embodiments, one or more of the openings 138-141 complement features of the electrical connector 104 such that the features slide through the openings 138-141.

Figure 8:
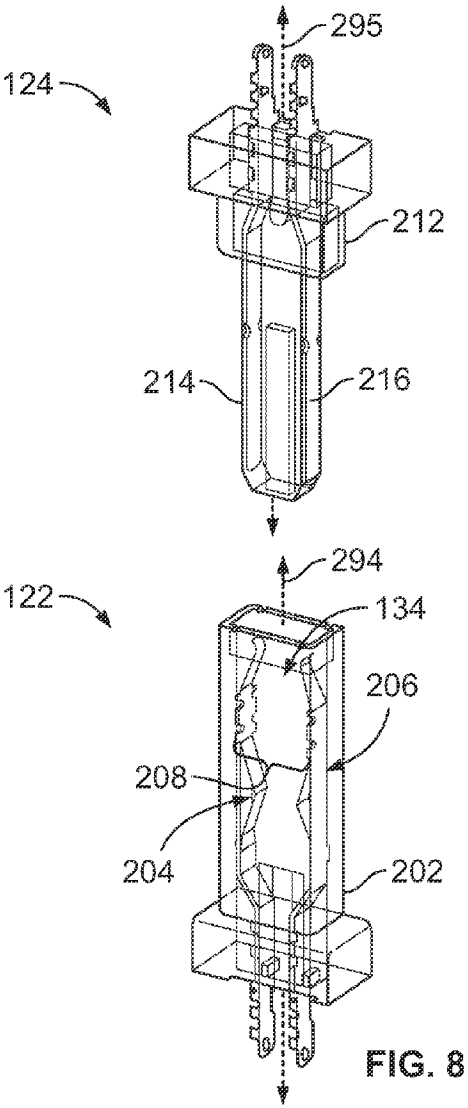
FIG. 8 is a perspective view of electrical terminals that may be used by the connector assembly of FIG. 1.

In an exemplary embodiment, the electrical terminals 122 constitute contact towers that project from the conductive surface 132 along the mating direction $M_1$. The electrical terminals 122 may also constitute socket contacts that have respective contact cavities 134 that are configured to receive the electrical terminals 124 (FIG. 8). The electrical terminals 122 extend from the conductive surface 132 a height H. The height H may be substantially equal to the depth $D_1$. As shown, the electrical terminals 122 have substantially equal heights H with respect to one another. In alternative embodiments, the heights H may be different.

Figure 3:
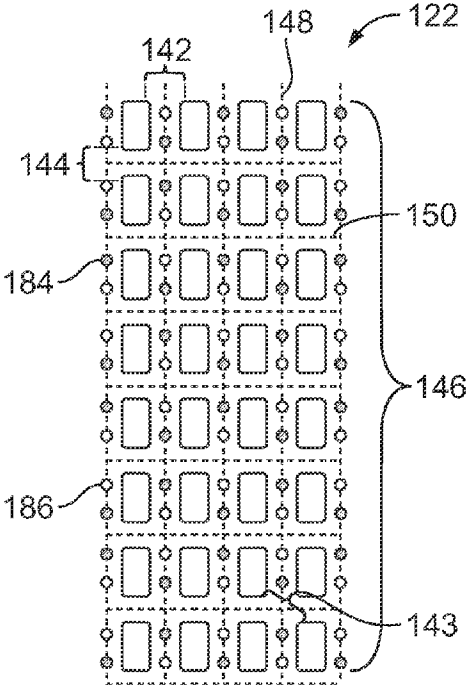
FIG. 3 is a representative view that illustrates an arrangement of terminals that may be used with the electrical connector of FIG. 2 and contact points that may occur in the connector assembly of FIG. 1.

FIG. 3 shows an arrangement of the electrical terminals 122 located on the conductive surface 132 (FIG. 2) according to an exemplary embodiment. As shown, the electrical terminals 122 are spaced apart from one another and positioned in an array along the conductive surface 132. In the illustrated embodiment, the electrical terminals 122 are arranged in rows and columns in the array. However, the array is not required to have linear rows or columns. Instead, the electrical terminals 122 can be located in any predetermined arrangement that is desired.

In the illustrated embodiment, adjacent terminals 122 may be separated by gaps 142 and by gaps 144. The gaps 142 extend generally along the lateral axis 192 (FIG. 1), and the gaps 144 extend generally along the lateral axis 193 (FIG. 1). Two terminals can be adjacent if no other terminal is located therebetween. As such, adjacent terminals 122 may also be separated by gaps 143 that extend diagonally with respect to the lateral axes 192, 193. The gaps 142-144 may collectively form an interwoven reception region 146 that extends along the conductive surface 132 between the electrical terminals 122.

The reception region 146 may include first and second paths 148, 150 in which each of the first and second paths 148, 150 extends through a plurality of the gaps that separate the electrical terminals 122. The paths 148, 150 may extend continuously therethrough without being interrupted by walls or other projections extending from the conductive surface 132. As used herein, a reception region is interwoven when at least two of the paths extend along a plurality of corresponding terminals and intersect each other. For example, the reception region 146 includes the first path 148 that extends along corresponding terminals 122 through the gaps 142, 143 and also includes the second path 150 that extends along corresponding terminals 122 through the gaps 144, 143. Each of the first and second paths 148, 150 extends along a series of terminals 122.

In an exemplary embodiment, the first path 148 extends parallel to the lateral axis 193, and the second path 150 extends parallel to the lateral axis 192 such that the paths 148, 150 intersect each other in a perpendicular manner. Also in an exemplary embodiment, the reception region 146 may include a plurality of first paths 148 and a plurality of second paths 150 that intersect one another. In the embodiment shown in FIG. 3, the paths 148, 150 are substantially linear and perpendicular to each other. However, in alternative paths, the paths 148, 150 may be non-linear and/or may not extend perpendicular to each other.

As will be described in greater detail below, the solid dots 184 and the hollow dots 186 shown in FIG. 3 represent contact points where the grounding matrix 106 engages the electrical connectors 102, 104 (FIG. 1).

Returning to FIG. 2, in some embodiments, the grounding matrix 106 may be positioned within the receiving cavity 126 along the conductive surface 132. As shown, the grounding matrix 106 can have a substantially planar body or frame 136 that includes ground contacts 152 and linkages 154, 155 that interconnect the ground contacts 152 in a web-like manner. The ground contacts 152 and the linkages 154, 155 may form terminal openings 156. When the grounding matrix 106 is positioned within the reception region 146, the ground contacts 152 and linkages 154 may be located in at least some of the gaps 142-144 (FIG. 3) and paths 148, 150 (FIG. 3). The electrical terminals 122 may advance through the terminal openings 156.

In an exemplary embodiment, the grounding matrix 106 is stamped-and-formed from a layer of sheet material. The grounding matrix 106 may be conductive throughout. However, the grounding matrix 106 can be formed in different manners in other embodiments. For example, in one alternative embodiment, the grounding matrix may include an organizer that holds separate ground contacts. The organizer may include the linkages.

As shown, the grounding matrix 106 may include edge members 160 along an outer perimeter of the grounding matrix 106. In one embodiment, the edge members 160 can be outwardly projecting tabs as shown in FIG. 2. The housing walls 128-131 may include interior slots or grooves 158 that are configured to receive the edge members 160. When the grounding matrix 106 is deposited into the reception region 146, the edge members 160 frictionally engage the slots 158. In some embodiments, the grounding matrix 106 is floatably coupled to the electrical connector 102 such that the grounding matrix 106 is movable with respect to the connector body 118. For example, the grounding matrix 106 can be at least floatable along the mating axis 191 toward and away from the conductive surface 132.

Figure 4:
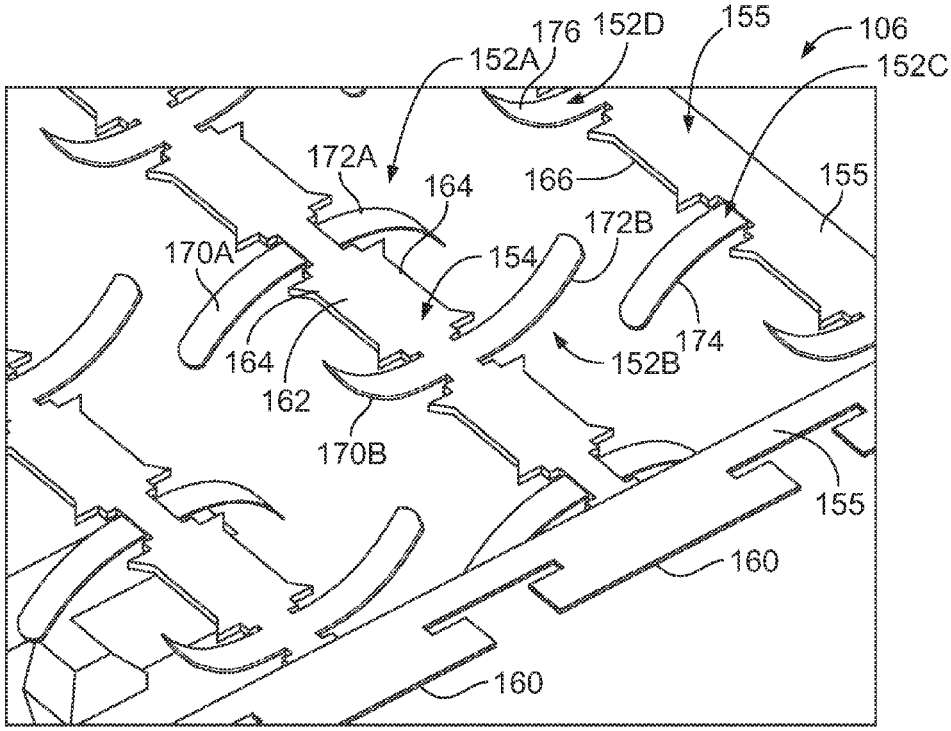
FIG. 4 is an enlarged perspective view of a portion of the grounding matrix that may be used with the electrical connector of FIG. 2.

FIG. 4 is an enlarged perspective view of a portion of the grounding matrix 106 showing the ground contacts 152 and the linkages 154, 155 in greater detail. As shown, the linkages 154 join adjacent ground contacts 152A and 152B. Thus, the linkages 154 may be characterized as inter-contact linkages. The linkages 154 have a linkage body 162 with contoured edges 164. The body 162 is sized and shaped to be positioned within a corresponding gap 144 (FIG. 3) between adjacent terminals 122 (FIG. 1). The edges 164 may be shaped to extend along an exterior surface of the corresponding terminal 122. In some embodiments, the linkages 154 may prevent movement of the grounding matrix 106 in a direction along a plane defined by the lateral axes 192, 193. In some embodiments, the linkages 154 may also be used to improve the shielding abilities of the connector assembly 100 (FIG. 1).

The linkages 155 join adjacent ground contacts 152C and 152D. In some embodiments, the linkages 155 extend along and define the perimeter of the grounding matrix 106. The linkages 155 may also include the edge members 160 extending outward therefrom. In an exemplary embodiment, the linkages 155 surround and enclose the ground contacts 152 therein. The linkages 155 may also have contoured edges 166 that are configured to extend along an exterior surface of the corresponding terminal 122.

Figure 5:
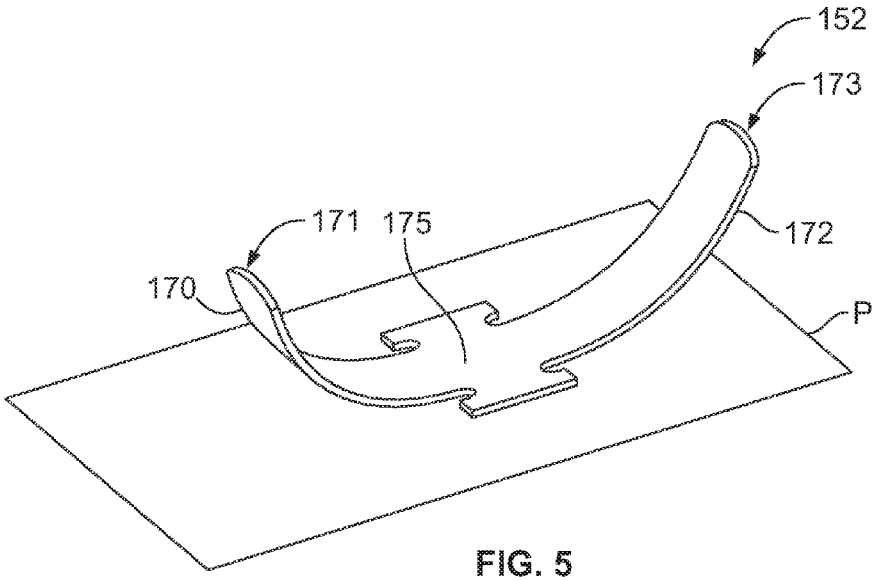
FIG. 5 is an isolated view of an exemplary embodiment of a ground contact that may be used with the grounding matrix.

FIG. 5 is an isolated view of an exemplary embodiment of the ground contact 152. Optionally, ground contacts described herein may include one or more flex portions that extend away from or toward the conductive surface 132 (FIG. 2). For example, the ground contact 152 shown in FIG. 5 has first and second flex portions 170, 172 and a contact base 175 that joins the flex portions 170, 172. The contact base 175 may be located within and extend along a contact plane P. The contact plane P may extend parallel to a plane defined by the lateral axes 192, 193 (FIG. 1). The flex portions 170, 172 extend from the contact base 175 in opposite directions away from each other to respective distal ends 171, 173. The flex portions 170, 172 also extend away from the contact plane P. In the illustrated embodiment, the flex portions 170, 172 curve or curl in the same direction away from the contact plane P. As such, the ground contact 152 may be substantially C-shaped or cup-shaped.

However, in other embodiments, the flex portions 170, 172 may have different shapes. For example, the ground contact 152 may have an overall V-shape or the ground contact 152 may have no curve and extend in a linear manner. One of the flex portions may extend in one direction away from the contact plane P, and the other flex portion may extend in an opposite direction away from the contact plane P. Also, in alternative embodiments, the grounding matrix 106 may not include the flex portions 170, 172. In such embodiments, the grounding matrix 106 may include only linkages 154, 155.

Returning to FIG. 4, the ground contacts 152 may have different features or characteristics with respect to one another. For example, the grounding matrix 106 may include different ground contacts 152A-D. The ground contacts 152A include flex portions 170A, 172A that extend toward the conductive surface 132 when the grounding matrix 106 is properly positioned. The ground contacts 152B include flex portions 170B, 172B that extend away from the conductive surface 132. The ground contacts 152C and 152D each include a single flex portion 174, 176, respectively. The flex portions 174, 176 extend toward and away from the conductive surface 132, respectively.

Figure 6:
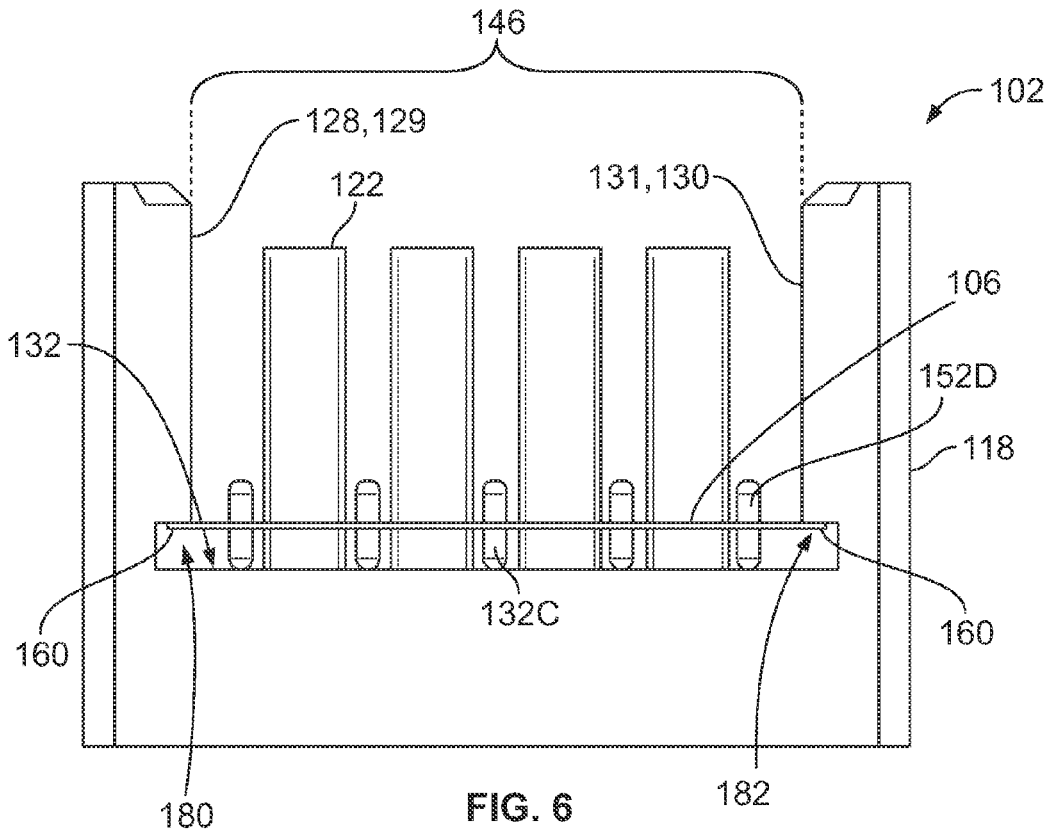
FIG. 6 is a side view of the electrical connector having the grounding matrix positioned within an interwoven reception region.
Figure 7:
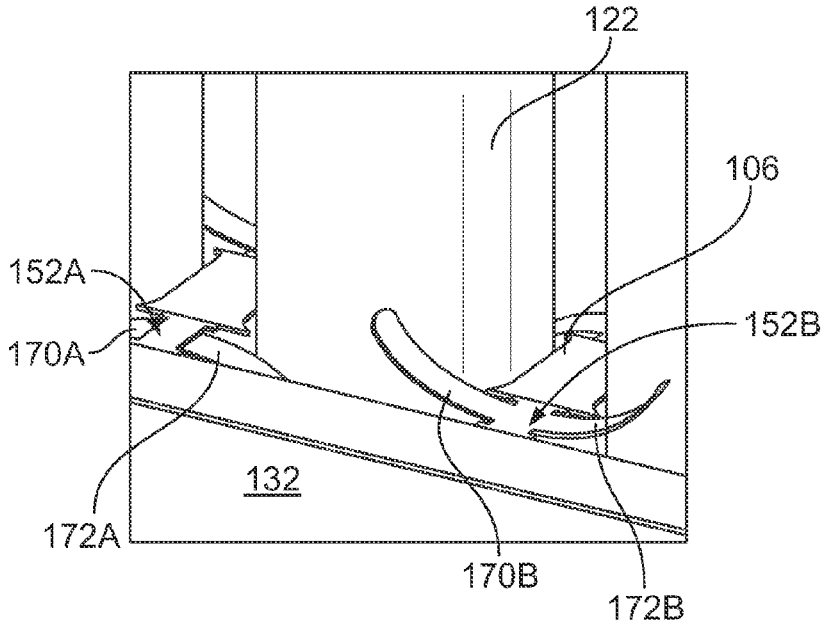
FIG. 7 is an enlarged perspective view showing the grounding matrix in greater detail.

FIG. 6 is a side view of the electrical connector 102 having the grounding matrix 106 positioned within the reception region 146, and FIG. 7 is an enlarged perspective view showing the grounding matrix 106 and the conductive surface 132 in greater detail. As shown in FIG. 6, the connector body 118 has a pair of longitudinal channels 180, 182 that extend through the connector body 118. The channels 180, 182 may be defined between the conductive surface 132 and the housing walls 128-131. The channels 180, 182 are configured to receive corresponding edge members 160 when the grounding matrix 106 is positioned within the reception region 146. When the grounding matrix 106 is inserted into the reception region 146, the edge members 160 may be partially deflected by the housing walls 128-131. The edge members 160 may resile back into a non-deflected position after entering the channels 180, 182, and clearing the housing walls 128-131.

With respect to FIGS. 6 and 7, the ground contacts 152A (FIG. 7), 152C (FIG. 6) engage the conductive surface 132 and the ground contacts 152B (FIG. 7), 152D (FIG. 6) extend away from the conductive surface 132. At least a plurality of the ground contacts 152 may be located adjacent to one or more of the electrical terminals 122, and at least a plurality of the ground contacts 152 may be located between two terminals 122. During the mating operation, the ground contacts 152A, 152C are configured to initially engage the conductive surface 132 and the ground contacts 152B, 152D are configured to initially engage a corresponding conductive surface 222 (shown in FIG. 9) of the mating connector 104 (FIG. 1). Accordingly, the grounding matrix 106 engages each of the conductive surfaces 132, 222 thereby establishing an electrical connection between the connector bodies 118, 120 (FIG. 1).

In an exemplary embodiment, the grounding matrix 106 engages the connector body 120 at a plurality of contact points 184 (shown as solid dots in FIG. 3) where the flex portions 170B, 172B (FIG. 7) contact the conductive surface 222. The grounding matrix 106 also engages the connector body 118 at a plurality of contact points 186 (shown as hollow dots in FIG. 3) where the flex portions 170A, 172A (FIG. 7) contact the conductive surface 132. In particular embodiments, the ground contacts 152A and 152B alternate in the array such that for each ground contact 152A that engages the conductive surface 132, the adjacent ground contacts 152B engage the conductive surface 222 and for each ground contact 152B that engages the conductive surface 222, the adjacent ground contacts 152A engage the conductive surface 132.

FIG. 8 is a perspective view of the electrical terminals 122, 124 isolated from the respective electrical connectors 102, 104 (FIG. 1). As described above, in some embodiments, the electrical terminals 122 and/or 124 may constitute contact towers. As shown in FIG. 8, the electrical terminal 122 includes a socket or contact housing 202 (shown in phantom lines) that includes the contact cavity 134. The electrical terminal 122 may also include a pair of conductors 204, 206 that extend generally along a central axis 294 of the electrical terminal 122. In an exemplary embodiment, the conductors 204, 206 comprise a differential pair of signal contacts. The conductors 204, 206 may be spaced apart from each other and define a terminal-receiving space 208 therebetween.

The electrical terminal 124 includes a contact housing 212 that extends along a central axis 295. The electrical terminal 124 also includes a pair of conductors 214, 216 that extend along the central axis 295. In an exemplary embodiment, the conductors 214, 216 extend along an outer surface of the contact housing 212 and have surfaces that are exposed to the exterior of the electrical terminal 124. When the electrical connectors 102, 104 are mated, the electrical terminal 124 is inserted into the terminal-receiving space 208 of the contact cavity 134. As the electrical terminal 124 advances into the terminal-receiving space 208, the conductors 214 and 204 slidably engage each other and the conductors 216 and 206 slidably engage each other.

Figure 9:
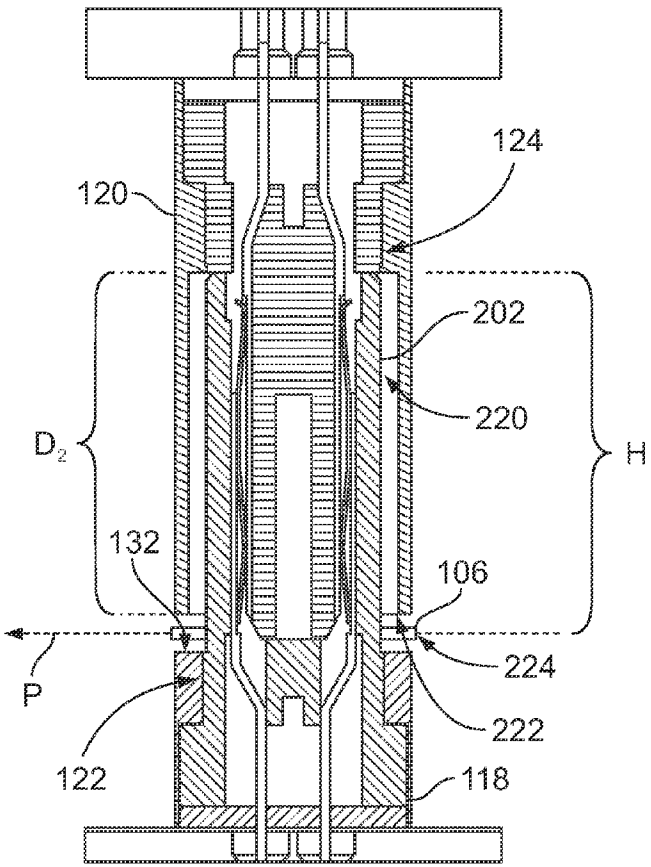
FIG. 9 is a cross-sectional view of the electrical terminals engaged to each other after a mating operation.

FIG. 9 is a cross-sectional view illustrating portions of the connector bodies 118, 120 and the electrical terminals 122, 124 engaged to each other after the mating operation. As shown, the connector body 120 has a conductive surface 222. The electrical terminal 124 is located within a terminal cavity 220 that extends a depth $D_2$ into the connector body 120 from the conductive surface 222. The electrical terminal 124 extends along the mating axis 191 (FIG. 1) toward the connector body 118. In some embodiments, an end of the electrical terminal 124 is substantially flush with the conductive surface 222. The terminal cavity 220 is sized to receive the contact housing 202 of the electrical terminal 122. As shown, the electrical terminal 122 projects the height H from the conductive surface 132 of the connector body 118. The height H is substantially equal to the depth $D_2$ of the terminal cavity 220 in the illustrated embodiment.

As shown in FIG. 9, the conductive surface 132 of the connector body 118 and the conductive surface 222 oppose each other along a mating interface 224 with the grounding matrix 106 located therebetween. The grounding matrix 106 electrically couples the conductive surfaces 132, 222 to establish a return path of the connector assembly 100. As shown, at least one of the electrical terminals 122, 124 can extend through the terminal opening 156 (FIG. 2) of the grounding matrix 106.

As described above, it is possible that the conductive surfaces 132, 222 may not be entirely complementary to each other due to the predetermined configuration of the conductive surfaces 132, 222 or due to the manufacturing tolerances and/or any unwanted particles located along the conductive surface 132 or the conductive surface 222. In such embodiments, the ground contacts 152 (FIG. 2) operate to electrically couple the conductive surfaces 132, 222 at multiple contact points 184, 186 (FIG. 3) throughout the mating interface 224. For example, each of the flex portions 170, 172, 174, 176 (FIG. 4) is configured to be compressed by one of the corresponding conductive surfaces 132, 222 and deflected toward the contact plane P of the grounding matrix 106. The flex portions 170, 172, 174, 176 can move independently with respect to each other based upon, for example, the shape of the conductive surfaces 132, 222. More specifically, the flex portions 170, 172, 174, 176 may be deflected different distances toward the contact plane P. When the electrical connectors 102, 104 are mated, each of the flex portions 170, 172, 174, 176 is configured to provide biasing force against the corresponding conductive surface 132 or 222 so that the electrical connection between the flex portion and the corresponding conductive surface is maintained throughout operation of the connector assembly 100.

As shown above, the ground contacts 152 are interconnected to each other by linkages 154, 155 in which the linkages 154, 155 and the ground contacts 152 are part of the same stamped-and-formed sheet material. However, in alternative embodiments, the ground contacts 152 may be indirectly coupled to each other through, e.g., an organizer or interposer. For instance, the organizer could include a planar dielectric body having holes configured to receive one or more ground contacts 152 and openings configured to receive the electrical terminals 122. In other embodiments, the ground contacts 152 may be entirely independent from each other such that each ground contact 152 is separately positioned within the reception region 146.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a connector body having a conductive surface configured to oppose an engagement side of a mating connector;

electrical terminals held by the connector body and located in an array along the conductive surface, wherein adjacent terminals are separated by gaps that collectively form an interwoven reception region along the conductive surface between the electrical terminals; and ground contacts coupled to the conductive surface and located in corresponding gaps, the ground contacts including flex portions configured to be compressed between the conductive surface and the engagement side of the mating connector when the mating connector is coupled to the electrical connector during a mating operation, the ground contacts being configured to electrically couple the conductive surface and the mating connector.

2. The electrical connector of claim 1, further comprising a grounding matrix that includes the ground contacts, the ground contacts being interconnected through linkages in a web-like manner.

3. The electrical connector of claim 1, wherein the ground contacts include first and second ground contacts, the flex portions of the first ground contacts configured to initially engage the conductive surface during the mating operation and the flex portions of the second ground contacts configured to initially engage the engagement side.

4. The electrical connector of claim 1, wherein at least some of the flex portions extend away from the conductive surface.

5. The electrical connector of claim 1, wherein at least one of the ground contacts includes a pair of flex portions that extend away from each other.

6. The electrical connector of claim 1, wherein the electrical terminals include contact housings that project away from the conductive surface, the gaps extending between adjacent contact housings.

7. The electrical connector of claim 6, wherein each of the electrical terminals includes a pair of conductors supported by the corresponding contact housing.

8. The electrical connector of claim 6, wherein each of the contact housings has a contact cavity configured to receive a mating terminal of the mating connector.

9. An electrical connector comprising:

a connector body having a conductive surface configured to oppose an engagement side of a mating connector;

a grounding matrix comprising a plurality of ground contacts that are interconnected in a web-like manner, the grounding matrix extending alongside the conductive surface and defining a plurality of openings; and electrical terminals coupled to the conductive surface and configured to engage mating terminals of the mating connector, the grounding matrix configured to electrically couple the engagement side of the mating connector and the conductive surface when the mating connector and the electrical connector are mated, at least one of the electrical terminals or the mating terminals extending through the openings of the grounding matrix after the mating operation.

10. The electrical connector of claim 9, wherein at least one of the ground contacts includes a pair of flex portions that extend away from each other.

11. The electrical connector of claim 9, wherein the ground contacts have flex portions, the flex portions configured to be compressed between the conductive surface and the engagement side to electrically couple the conductive surface and the mating connector.

12. The electrical connector of claim 11, wherein at least some of the flex portions extend away from the conductive surface.

13. The electrical connector of claim 9, wherein the electrical terminals include contact housings that project away from the conductive surface.

14. The electrical connector of claim 13, wherein each of the electrical terminals includes a pair of conductors supported by the corresponding contact housing.

15. The electrical connector of claim 13, wherein each of the contact housings has a contact cavity configured to receive a corresponding mating terminal of the mating connector.

16. An electrical connector assembly comprising:

a mating connector having an engagement side and a plurality of mating terminals located therealong;

a grounding matrix comprising a plurality of ground contacts that are interconnected in a web-like manner, the grounding matrix defining a plurality of openings; and a header connector comprising:

a connector body having a conductive surface configured to oppose the engagement side of the mating connector;

electrical terminals coupled to the connector body in an array and configured to engage the mating terminals of the mating connector;

wherein the grounding matrix is located between the engagement side and the conductive surface along a mating interface, the grounding matrix electrically coupling the engagement side and the conductive surface after a mating operation, at least one of the electrical terminals or the mating terminals extending through the openings of the grounding matrix.

17. The connector assembly of claim 16, wherein the ground contacts have flex portions configured to be compressed between the engagement side and the conductive surface to electrically couple the conductive surface and the mating connector.

18. The connector assembly of claim 16, wherein the electrical terminals include contact housings that project away from the conductive surface.

19. The connector assembly of claim 18, wherein each of the electrical terminals includes a pair of conductors supported by the corresponding contact housing.

20. The connector assembly of claim 18, wherein each of the contact housings has a contact cavity configured to receive a corresponding mating terminal of the mating connector.

* * * * *